United States Patent [19]

Wolff

[11] 4,141,821

[45] Feb. 27, 1979

[54] SCREENING DECK ASSEMBLY

[75] Inventor: Kurt Wolff, Dinslaken, Fed. Rep. of Germany

[73] Assignee: Firma Steinhaus GmbH, Mulheim (Ruhr), Fed. Rep. of Germany

[21] Appl. No.: 746,376

[22] Filed: Dec. 1, 1976

[30] Foreign Application Priority Data

May 21, 1976 [DE] Fed. Rep. of Germany ..... 2622709
Jul. 20, 1976 [DE] Fed. Rep. of Germany ..... 2632511

[51] Int. Cl.[2] ..... B07B 1/46
[52] U.S. Cl. ..... 209/405; 209/395
[58] Field of Search ..... 209/399, 398, 405, 408, 209/395; 29/451, 453, 403

[56] References Cited

U.S. PATENT DOCUMENTS

| | | | |
|---|---|---|---|
| 1,013,890 | 1/1912 | Olsen | 209/399 X |
| 1,295,289 | 2/1919 | Fasting | 209/399 X |
| 2,423,442 | 7/1947 | Dustan | 209/399 X |
| 2,468,985 | 5/1949 | Krotz | 29/450 X |
| 2,676,391 | 4/1954 | Elder | 29/450 |
| 2,740,525 | 4/1956 | Wehner | 209/399 |
| 2,876,485 | 3/1959 | Cowles | 29/450 X |
| 3,091,795 | 6/1963 | Budwig | 29/453 X |
| 3,194,397 | 7/1965 | Taege | 209/398 X |
| 3,285,428 | 11/1966 | Scheck | 29/453 X |
| 3,624,867 | 12/1971 | Reynolds | 29/451 X |
| 3,871,057 | 3/1975 | Moulin | 29/451 X |
| 3,980,555 | 9/1976 | Freissle | 209/399 |

FOREIGN PATENT DOCUMENTS 884899 7/1953 Fed. Rep. of Germany ..... 209/399

*Primary Examiner*—Robert Halper
*Attorney, Agent, or Firm*—Pollock, Vande Sande & Priddy

[57] ABSTRACT

A screening assembly comprising a plurality of screening elements, with each element including at least one hollow tubular protrusion extending through an aperture formed in a supporting grid. The protrusion is formed with a smaller diameter than the aperture and is expanded into clamping contact with the aperture by insertion of a securing pin through the protrusion.

23 Claims, 17 Drawing Figures

Fig. 12
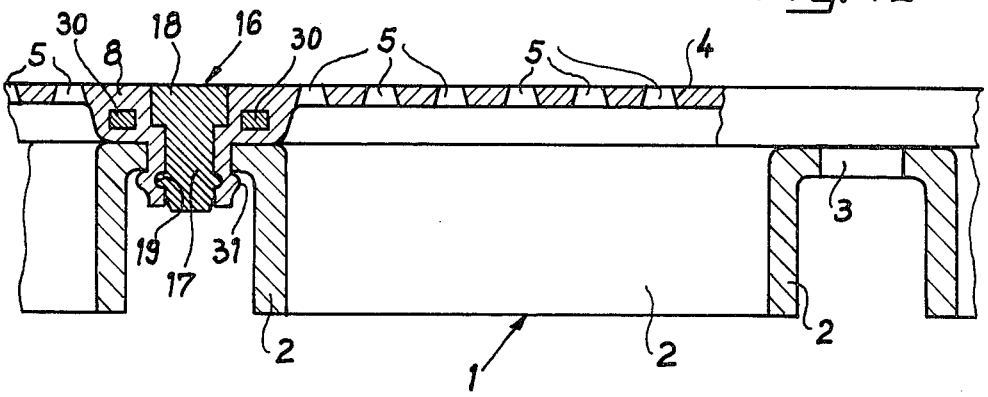
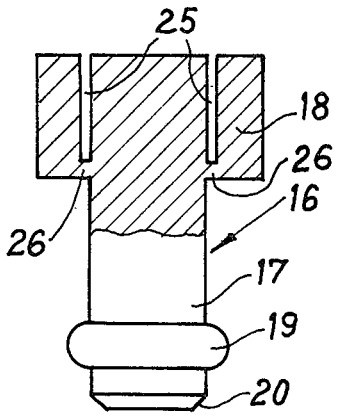
Fig. 13
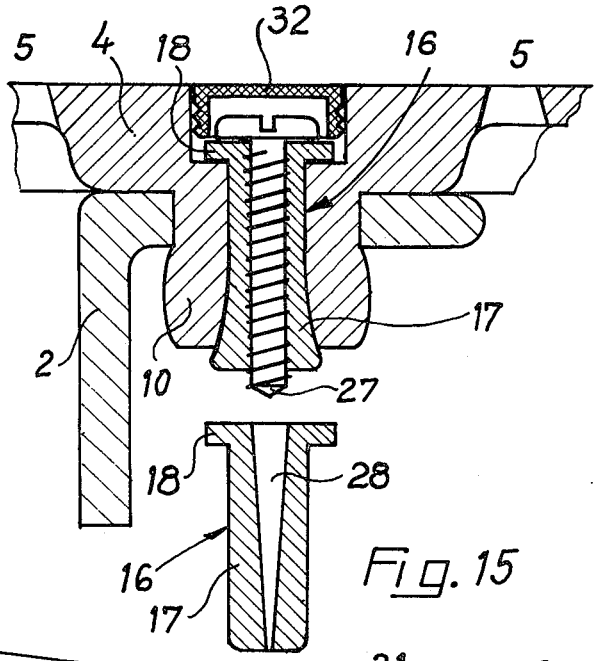
Fig. 15
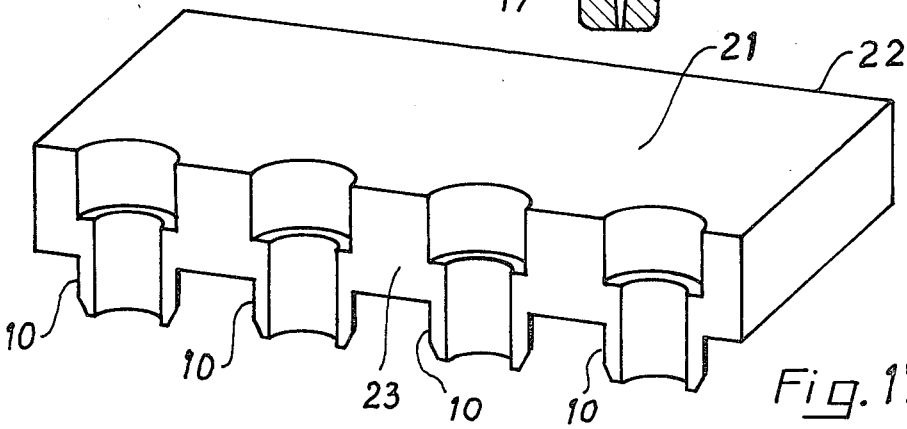
Fig. 17

SCREENING DECK ASSEMBLY

BACKGROUND OF THE INVENTION

This invention relates to a screening deck consisting of a rigid, frame-like supporting grid, resilient screening elements, forming a composite screen area including protrusions located adjacent one another which project from the edge of the screen elements through holes in the cross-bars of the support frame, whereby the protrusions of neighbouring elements are releasably secure the screening elements to the support frame, with this arrangement, it is possible to replace individual screen elements which become worn without replacing the entire screen.

A screen deck of this type is described in DT-OS 24 37 809 wherein the protrusions on the underside take the form of latch buttons. The screening elements are secured to the support frame by means of clip or snap connections for which adjacent elements must be held together before being fitted to the grid in order that the respective protrusions may together form a complete latch button which can then be pushed through the aperture in the bar of the support frame. This poses the difficulty that the elements can only be fitted to the support frame with difficulty because the adhesion and cohesion of the abutting surfaces of the parts forming together a latch button prevent relative movement of adjacent parts. Finally, because of the clip or snap effect, an especially high surface pressure occurs between the abutting faces of adjacent protrusions. For this reason, a subsequent replacement of single screen elements is very difficult. Slots can be provided in the wide heads of the protrusion so that they may be pressed together and withdrawn through the apertures in the support frame, but the retaining effect is thereby greatly reduced. In practice it is usual to cut off the heads of the protrusions of the element which is to be replaced below the support frame so that the screen element can then be removed. Damage to the removed element can hardly be avoided, so that re-use of an exchanged element is often no longer possible. The known screens, therefore, are not suitable for repeated replacement of the screen elements, whereby the elements may be refitted in the same or another position on the grid.

Furthermore, it is also known to provide screen decks with resilient screening elements which are secured to a rigid carrier grid. The support-bars are provided with apertures through which screws embedded in the screen element are passed and secured from below by means of screw nuts ("Aufbereitungstechnik", 8/1967, from page 646 on, and "Aufbereitungstechnik", 11/1970, from page 383 on.). Replacing individual screening elements on this kind of screening surface is even more complicated because special tools are needed for fitting and removing the securing screws, which are subject to corrosion problems.

Screening decks with resilient synthetic screening elements are also known, wherein the edges of the screening elements are provided with mushroom shaped protrusions which fasten like press studs in connecting bars arranged between the screen elements (DT-AS 1 814 839). The anchor-like protrusions are arranged parallel to the plane of the screen elements, and the overlap at the sides is compensated for by the connecting bar. The purpose of the invention therefore, is to provide a screening deck of the type described which, in place of the snap connections, provides protrusions in the form of locating means on the under side of the screen element, and separate securing means therefor.

BRIEF SUMMARY OF THE INVENTION

This purpose is achieved by way of a screen deck of the kind described according to the invention wherein the protrusions on the under side of the screen elements take the form of longitudinally split tube sections which, when fitted through the apertures in the support-bars are complementary in forming a complete tube with a longitudinal aperture through which a securing pin is fitted having means for spreading the resilient material of the tubular protrusion.

The particular advantage of the screen deck according to the invention is that the screen elements can be first loosely located on the grid, after which adjustment of single elements is still possible. Unlike the known arrangement which comprises latching elements, rigid securing of the elements during assembly on the grid is not necessary. The screen elements are locked in position by insertion of the securing pins. To remove the elements from the grid, the pins need only be extracted and the elements are once again loosely located on the support-bars whereby a given element can be easily replaced. Fitting the locating pins is also very easy, they can be easily inserted manually and removed by either being knocked out of the support-bars, or withdrawn from the top of the elements by means of a tool.

In an advantageous arrangement according to the invention, the tube sections can be situated on the long edges and/or on the corners of the screen elements. The tube sections located on the long edges of the elements are of semicircular section, so that two opposing tube sections on adjacent screen elements combine to form a complete tube. The tube sections located on the corners of the screen elements are also split longitudinally and have radial surfaces, but would be of section equal to either a quarter, a third or a sixth of a circle depending on the number of adjacent corners with tube sections which combine to make an entire tube.

Connecting the corners of the screen elements to the support-bars have the further substantial advantage that the cross-bars of the grid do not need to support the screen elements along their entire perimeter.

Further advantages of the invention are apparent from the and from the following description.

BRIEF DESCRIPTION OF THE DRAWINGS

Embodiments of the invention will be more closely explained in the following with the aid of the drawings. Showing in:

FIG. 9 or 10, FIG. 12 : partial view of a section through a screen deck according to the invention, FIG. 13/16 : alternative embodiments of securing pins for screening decks according to the invention and FIG. 17 : support-bars for a screening deck according to the invention.

DESCRIPTION OF PREFERRED EMBODIMENTS

Figure 1:
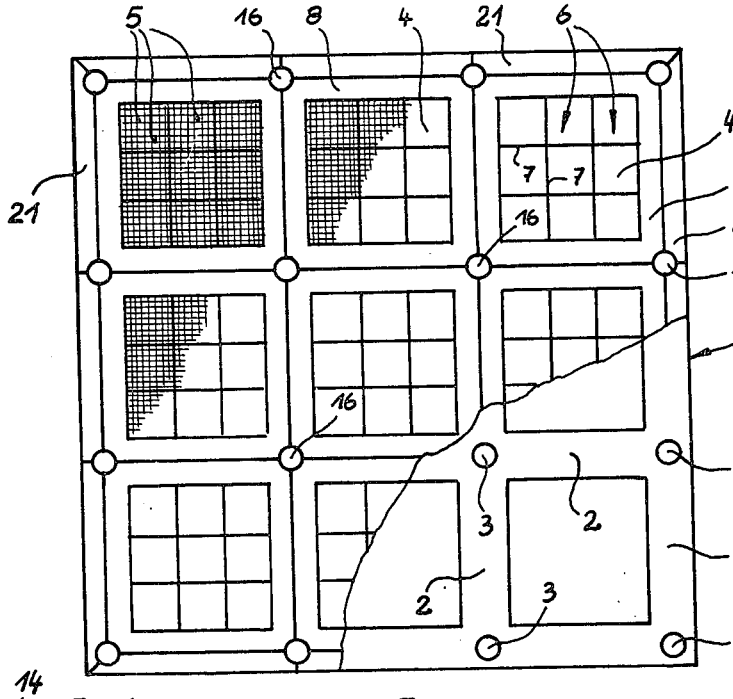
FIG. 1 : a plan view of a screen deck according to the invention with fitted elements partly removed.

In FIG. 1 a screen deck according to the invention is schematically illustrated as comprising of a grid 1 with support-bars 2 and screening elements 4 arranged thereon. The support-bars 2 of this embodiment are provided in two directions and at the points where they cross, with apertures 3 for securing the screen elements 4 in a manner described in the following. The support-bars 2 may also be arranged in parallel relationship as will be explained in connection with FIG. 7.

In a known manner, the screening elements 4 have openings 5 spread over several screening zones 6. The screening zones 6 are bordered by stays 7, whereby the number and arrangement of the stays 7 is dependent on the choice of material for the screen elements 4. Around the screening zones 6, the screening elements 4 are provided with frames 8 on their under side, which are in contact with the support-bars 2. Each of the screening elements 4 overlaps about half the width of the support-bars 2, such that adjacent elements 4 are in contact along their side surfaces 9 (FIG. 2)

The screen elements 4 are made of a wear resistant resilient material. Synthetic materials which might be considered for this purpose can easily be shaped into screening element 4 in moulds. Alternative embodiments can be injection moulded in one piece, and provided with supporting ribs to ensure sufficient stability. Apart from separating the substance being screened, the screened elements 4 also serve to protect the grid 1 against abrasive wear. The screening elements, therefore, can also take the shape of solid panels at, for example, the points of extreme abrasion on a screening machine, and also on the side walls of the respective screening box.

Since it is practical to make all the screening elements 4 used on a sieve block the same size, the spaces which occur at the edges of the grid 1 are filled with frame bars 21.

Figure 2:
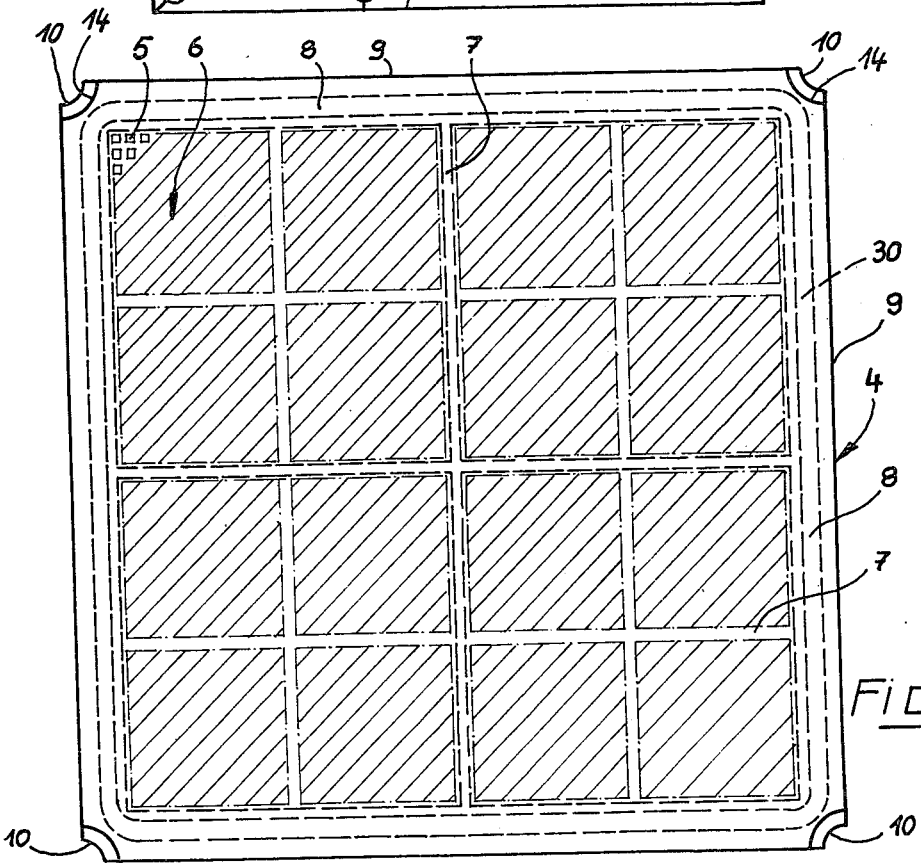
FIG. 2 : a plan view of a single screen element of the screen block in FIG. 1, FIG. 3 : a perspective, corner view of the screen element in FIG. 2 with exploded view of the securing pin.

FIG. 2 is an enlarged illustration of a screening element 4 such as is preferably used in a screening deck according to the invention. In this embodiment, the screening element 4 has a basically square shape, however, the screening element 4 may take any shape convenient for a particular screening deck according to the invention. It is possible to make the screening elements 4 rectangular, triangular or in any selected polygonal form. The only design requirement is that the tube sections be positioned either on the corners or on the sides, or on both the corners and the sides, as may be seen by the recesses at the corners in FIG. 2 and by the recesses along the sides in FIG. 11.

Figure 3:
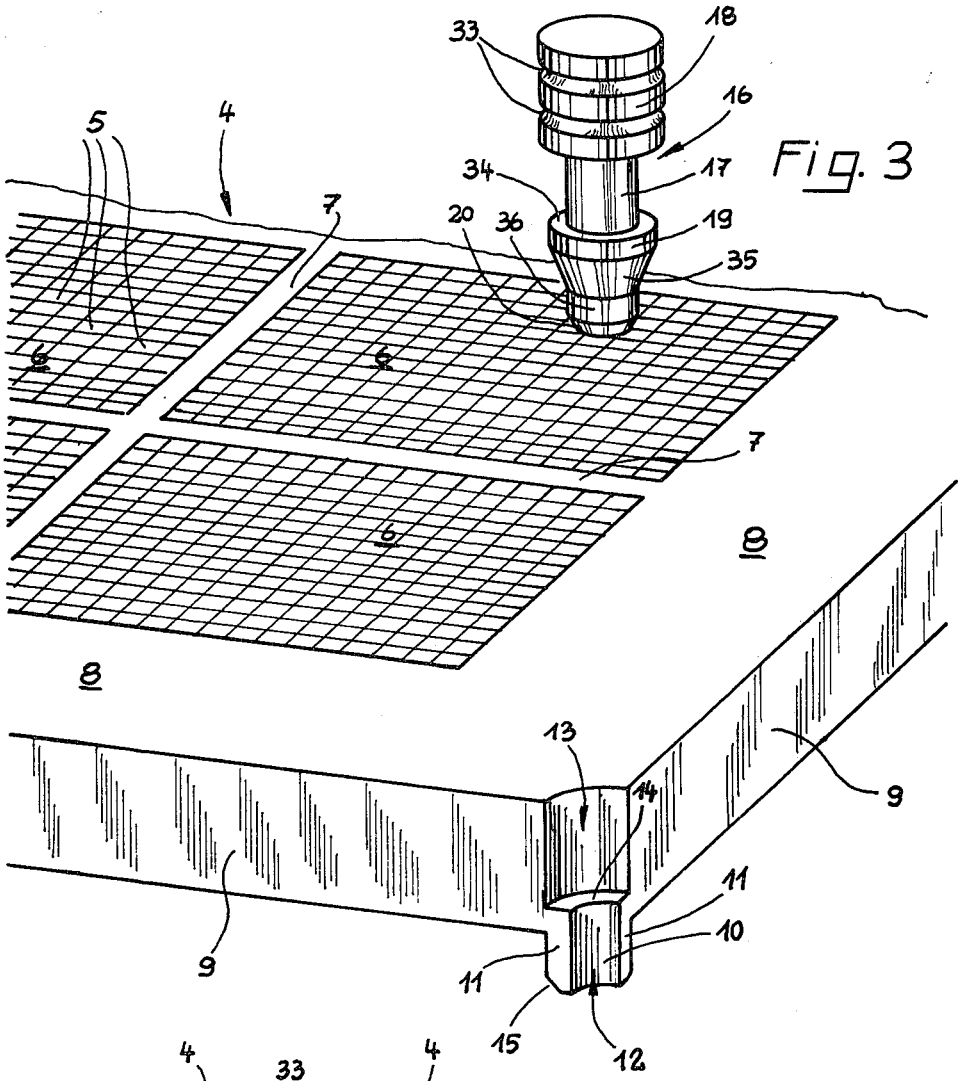

The integrally moulded tube section 10 can be clearly seen at the corner of the screening element 4 shown in FIG. 3. It should be understood that such a tubular section has the shape of a tube with two longitudinal sections having surfaces on radial planes. In the embodiment according to FIG. 3, the tube section 10 is in the form of a 90 degree sector so as to correspond to the square base shape of the screening element 4. Accordingly the four tube sections 10 of four adjacent screening elements 4 combine to form a whole tube. If, for example, a hexagon is the selected base shape of the screening element 4, the corners of three adjacent screening elements will join in order to form a complete tube. As far as the tube sections 10 being arranged on the side surfaces 9 of the screening elements, the shape will be semi-circular as described herein. In all cases, it is advantageous for the sectioned surfaces of the tube sections 10 to be on a plane with the side surfaces 9 of the respective screening elements 4.

The tube sections 10 project beyond the underside of the screening elements 4. The screening elements 4 are located on the grid 1 by means of the protruding tube sections 10, whereby the tube sections 10 extend through the holes 3 in the support-bars 2. The diameter of the holes 3 is preferably slightly larger than that of the combined tube sections 10, such that the screening elements 4 can be loosely located on grid 1 and thereafter slightly adjusted relative to each other. This considerably alleviates the difficulty of exactly positioning of the sieve elements 4. The free play between adjacent screen elements 4 and their tube sections 10 the untensioned condition can be seen in FIG. 4.

Figure 4:
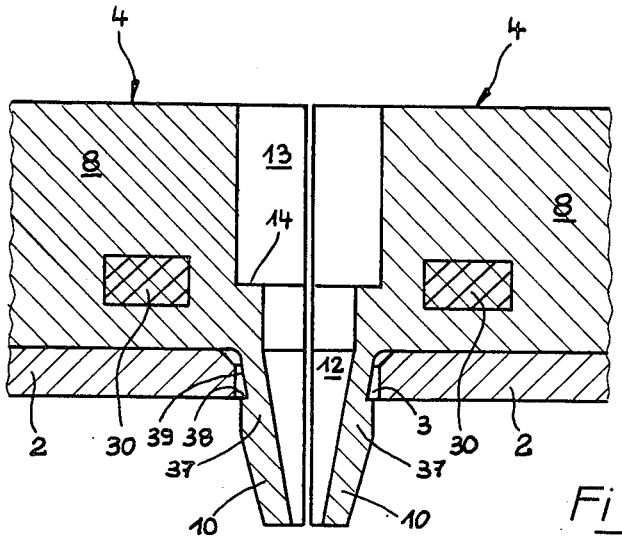
FIG. 4 : a section through two adjacent screen elements of a screen deck, showing the corner zone where the tube sections combine.

The FIGS. 3 and 4 clarify further that joined tube sections 10 of adjacent screen elements 4 contain through-hole 12 which widens towards the top to a bore 13. The bore 13 which extends to the top of the screening element 4, also extends downwards beyond the half thickness of the screening element 4 to a shoulder 14 from which the through-hole 12 continues. The bore 13 including the shoulder 14 along with the upper portion of the through-hole 12 are each formed by corresponding recesses on the corners of the screening elements 4. In principle, the bore 13 need not be circular, it can, take the form of a planar figure. The same is true for the tube sections 10 and the holes 3 in the support-bars 2, which can also be polygonal provided that the basic shapes of all parts correspond. It is essential that the tube sections 10 formed at the corners of the sieve elements 4 fit through the holes 3 in the support-bars 2. Furthermore, it is especially advantageous if the bore 13 is given a slightly larger diameter than the external diameter of the tube section 10, so that the screening elements 4 can be compactly piled.

When the screening elements 4 are laid one upon the other, the tube sections 10 fit into the corresponding corner portion of the bore 13, so that the upper and lower surfaces of the piled up screening elements 4 are in contact, providing that the depth to the shoulder 14 is slightly greater than the extent of the projection of the tube section 10 from the under side of the screening elements 4.

Accordingly, the screening elements 4 are prelocated on the grid 1 by means of the tube sections 10 extending into the holes 3 in the plane of the screen. Insertion of the tube sections 10 into the holes 3 in the grid support-bars 2 is made easier by the provision of chamfers 15.

The complementing tube sections 10 fit into the holes 3 without any pressure or tension, that whereby the screening elements 4 can be assembled on the support-bars 2 independently of one another. Furthermore, the play between the individual screen elements 4 can be made sufficiently large resulting in the friction between the side surfaces 9 being negligible. The gap between the screening elements 4 assembled on the grid 1 is still sufficiently large as to allow a subsequent adjustment of the screen elements 4. Only then does the securing of the screening elements 4 in a vertical direction take place, by means of the securing pins 16 being pressed downwardly through the bores 13 and the through-holes 12 at the corners of the screening elements 4. This method of securing the screening elements 4 does not require a tool.

The securing pin is depicted, in an exploded view in FIG. 3. It has an upper head 18, the diameter of which corresponds to the bore 13, in order to ensure as close a fit as possible. The height of the head 18 corresponds to the position of the shoulder 14 beneath the surrounding upper surface of the screening elements 4. Therefore, the top of the head 18 of an inserted securing pin 16 is in the same plane that includes the upper surface of the adjacent screening elements 4 (e.g. FIG. 5 and 6).

Around the head 18 of the securing pins 16, one or more grooves 33 may be provided which make it easier to extract the securing pins 16 upwards out of the sieve elements 4. With the aid of a simple screw-driver, the securing pins 16 can be levered out of the screen deck by forcing the blade of the screw-driver between bore 13 and the head 18 until it locates in one of the grooves 33. By levering the screw-driver to the side, the securing pin 16 can then be raised to the extent of the located groove 33. If necessary, the screw-driver can be re-inserted to the next lower groove until finally, the securing pin 16 is extracted by hand.

Positioned beneath the head 18 on the securing pin 16, is a narrow neck 17, with a diameter corresponding to the diameter of the through-hole 12. Securing pin 16 further comprises a radial shoulder 34 joining the neck 17, with the shoulder 34, inturn, joining a spreader 19 and a cone 35 with an extension 36 upon which is a bevel 20 at the end of the securing pin 16.

Figure 6:
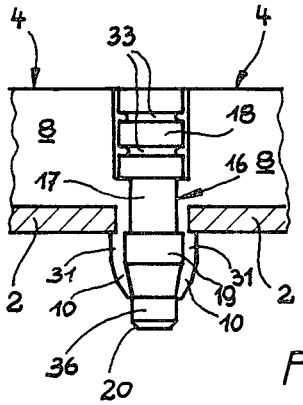
FIG. 6 : a section through another embodiment of adjacent screening elements as in FIG. 4 with the securing pin in position.

The operational position of the securing pin 16 is illustrated in FIG. 6. The spreader 19 of the securing pin 16 has a somewhat larger diameter than that of the through-hole 12 adjacent the tube sections 10. The spreader 19 therefore, radially widens the tube sections 10 in the holes 3 of the support-bars 2, resulting in the elastic deforming of the screening element material at this point. The tube sections 10 are expanded 31 by contact with securing pin 16 to clamp the support-bars 2 between the screen elements 4 and the widened tubes 10. In principle, the securing pins 16 can be shaped such that the tube section 10 are secured only by the clamping effect of the support bars 2 on the walls of the holes 3. In the case of both contact fit and clamping, the lower cone 35, the extension 36 and bevel 20 of securing pin 16 all function to ease the insertion of the securing pin 16 in the through-hole 12 which is shaped by the combined tube sections 10.

Figure 5:
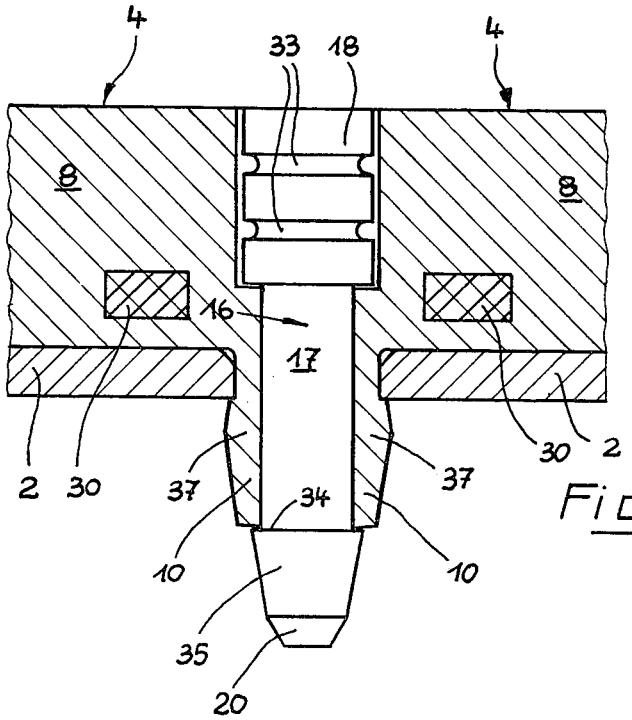
FIG. 5 : a section through adjacent screening elements as in FIG. 4 with the securing pin in position.

In the embodiment according to the FIGS. 3 and 6, the through-hole 12 shaped by the tube sections 10 has the same diameter throughout, with the securing of the tube sections 10 occuring exclusively by means of expansion wherein, the tube sections 10 of the embodiment according to the FIGS. 4 and 5 form a through-hole 12 decreasing in diameter towards its lower zone. The securing pins 16, however, have a downwardly extended, cylindrical neck 17 which necessarily spreads the narrowing through-hole 12. This results in the spreading of the tube sections 10 which are again secured by clamping or by contact fit in the holes 3 of the support-bars 2. By example, the tube sections 10 according to FIG. 4 have thicker outer portions 37 which join recess 39 stepped from the thicker portions 37 by radial ridges 38. Because of the recess 39, the tube sections 10 of the screening elements 4 are initially only loosely located in the holes 3 of the support-bars 2. After the insertion of the corresponding securing pin 16, the recessed portion 39 of the tube sections 10 makes contact with the inside of the holes 3 of the support-bars 2, whereby the radial ridges 38 fasten under the edges of the holes 3. Thus, the thicker portion 37 cannot be withdrawn through the hole 3 when a securing pin 16 has been fitted, achieving a form fit which can be additionally combined with a clamping of the tube sections 10 in the area of their recesses 39. It is practical, with this embodiment, to provide the shoulder 34 at the lower end of the neck 17 such that it can be positioned below the lower edge of the tube section 10. A locking effect can be achieved because the tube section 10 are sufficiently elastic. The securing pins 16, like the screening elements 4 and their tube sections 10, can be made of an elastic material. For this purpose, the same synthetic resinous material used in the screening elements 4 may advantageously be used, to provide uniform wear over the entire surface of the screen deck. Undesirable lumps or depressions in the area of the heads 18 of the securing pins 16 which extend to the upper edges of the screening elements 4 will be avoided.

In cases of especially heavy wear, it may be advisable to use a harder, tougher material, for the securing pins 16 and/or for the frames 8 of the screening elements 4 upon which the tube sections 10 are integrally formed, than the material used for the screen zones 6 of the screening elements 4. Although the manufacture of a complete one-piece screening element 4 is then not possible, an especially stable embodiment of the sieve element 4 in the area of the frame 8 and the tube sections 10 can be achieved. This is of special importance at the corners where the tube sections 10 are widely spaced, and when the screening elements 4 are not supported along the frames 8. Further rigidity for the screening elements 4, is provided by additional arms 30 located adjacent the frames 8.

Figure 7:
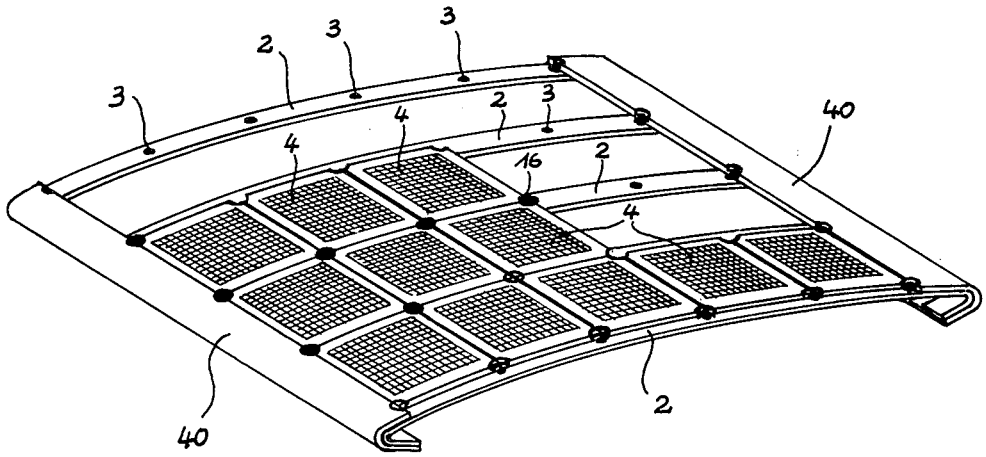
FIG. 7 : a further embodiment of a screen deck according to the invention, in perspective.

Securing the corners of the screening elements 4 to the support-bars 2 leads to a very simple construction of the grid 1 when an all-round support of the screening elements 4 is not desired. The support-bars 2 can then be arranged in parallel and spaced at a distance equal to the width of the screening elements 4, with only those parts of the frame 8 which lie in the direction of the support bars being supported. Such a screening deck is shown in FIG. 7. This embodiment is especially suited for a tensioned screening deck distinguished by the raised middle portion of the supporting grid and the tensioning elements 14 at the sides thereof. The support-bars 2 are set in the direction of the tension, such that the screening elements 4 are not stressed in any way.

Figure 8:
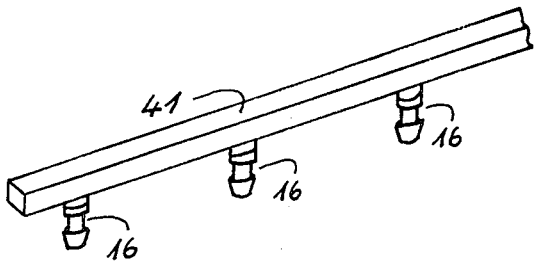
FIG. 8 : view of a guide rib screen deck.

The head 18 of the securing pin 16 remains on a level with the top surface of the screening elements 4. In order to ensure distribution of the material being screened over the active screening zones 6, it may be necessary to distribute guide ribs over the entire screen deck, which stand apart from the upper surface of the screen deck. In a further embodiment of the invention, the securing pins 16 can be combined with the guide ribs formed directly on the heads 18 of the securing pins 16 in prismatic, spherical or other shapes. These projecting bodies are intended to guide the material being screened to one or both sides during the screening operation. It may also be desirable to guide the material being screened over a long distance, or to dam it on the screen deck whereby longer guide ribs may correspondingly serve. Securing such longer ribs can advantageously be carried out in combination with the positioning of securing pins 16. FIG. 8 shows such a damming rib 41 which is provided with two or more securing pins along its lower side. As with the short guide ribs, the damming rib 41 can be rigidly connected to the securing pins 16, or even be integrally formed by moulding in plastic.

Whereas the above described embodiments of screen deck according to the invention are such having screening elements 4 with tube sections arranged at the corners thereof, screening elements 4 described in the following have tube sections 10 situated along the sides thereof. It is also possible in accordance with the invention to provide screen decks with screening elements 4 which have tube sections 10 on both their sides and their corners. The holes 3 in the support-bars 2 of the grid 1 are correspondingly arranged, whereby the support-bars 2 of the grid 1 can support the entire frame 8 or merely opposite sides thereof. According to the particular type of grid 1, the screening elements 4 can have the tube sections 10 on all sides of the frame 8 or only on the side surfaces 9 of opposite frame sides 8.

Figure 11:
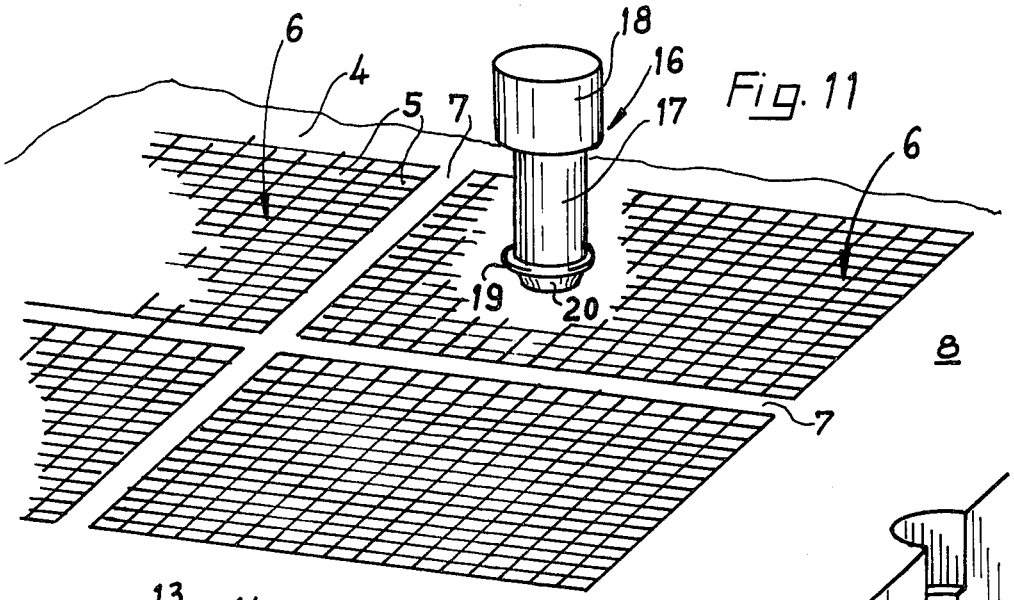
FIG. 11 : a perspective view of part of a single screen element for a screening deck according to either
Figure 16:
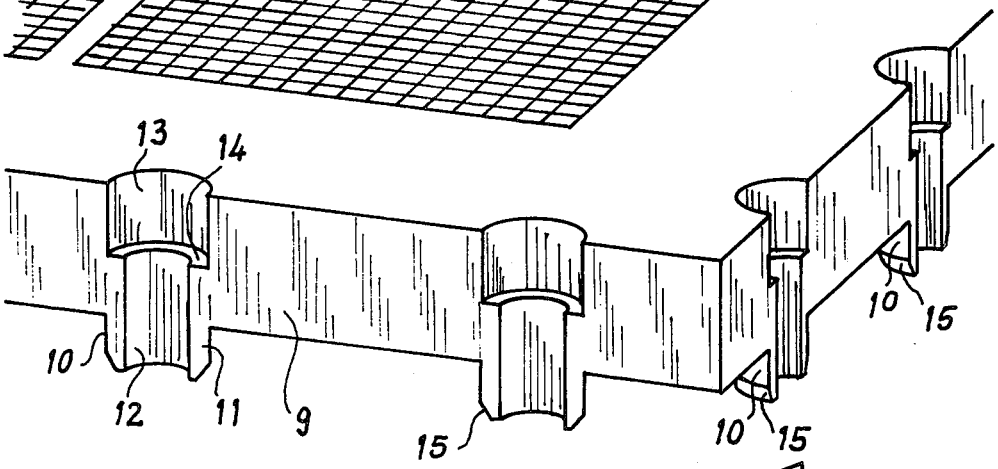

In order to ensure sufficient rigidity of the entire frame-like grid structure 1, the support-bars 2 of the grid 1 are shaped as U-sections with the open side down (FIG. 12) or to one side (FIG. 16). Here too, the screening elements 4 have tube sections 10 under the frame sides 8 lying on the support-bars 2, for releasable connection to the grid 1 as shown in FIG. 11. The tube sections, are of semicircular shape, and, as with the tube sections on the corners, are formed integrally with the screening elements 4. They consist therefore, of the same synthetic resilient material used for the frame sides 8 of the screening elements 4. The semicircular tube sections 10 are diametrically, longitudinally sectioned and positioned on the screening elements 4 such that the sectioned surface 11 is on a plane with the side surfaces 9 of the screening elements 4. The form of the semicircular tube section 10 is a matter of choice, however, the preferred embodiment of the tube sections is half round or half cylindrical. With the semicircular tube sections 10, the external diameter is slightly smaller than the diameter of the holes 3 in the support-bars 2, so that the semicircular tube section 10 easily fits with slightly free play in the corresponding hole 3. As with the tube sections at the corners, the preferred embodiment is such that the semicircular tube sections 10 project beyond the base of the screening element 4 to the extent that after the screening element 4 has been located on top of the support-bar 2, the tube sections 10 reach through the holes 3 to stand clear of the walls of the support-bar 2. This extension is of special importance for the various means of securing the screening elements 4 with the tube sections 10.

In the following, the tube section 10 has a preferred semicircular shape and is generally refered thereto. The semicircular tube section 10 also has an inner through-hole 12 which is of a cylindrical form and reaches about as far as the middle plane of the screening element 4. The through-hole 12 continues as a bore 13 which reaches to the upper side of the screening element 4. In the preferred embodiment, the half round bore 13 has a somewhat larger diameter than the through-hole 12 so that a shoulder 14 is formed between the half round bore 13 and the through hole 12. The depth of the shoulder 14 from the top surface of the screening element 4 is equal to or greater than the extent of the projection of the tube section below the base of the screening element 4 such that the diameter of the half round bore 13 is greater than the external diameter of the tube section 10, providing good stacking of the screening elements 4.

When the screening elements 4 are located on the support-bars 2 of the grid 1, the semicircular tube sections 10 each fill about half of the hole 3 with slight play. Since the screening elements 4 are positioned on the grid 1 with the side surfaces 9 in seamless contact, the semicircular tube sections 10 with their through-holes 12 and half round bores 13 take correspondingly mating position relative to each other. They are complementary in forming a cylindrical tube with a cylindrical through-hole 12 and a bore 13, which extends through the corresponding hole 3 in the support-bar 2 of the grid 1. Like the tube sections on the corners, the semicircular tube sections 10 combine to form a tube which fits without pressure or stress in the holes 3 in the support-bars 2. Thus, with the tube sections 10 arranged on the sides, the screening elements 4 can be located on the support-bars 2 independently of each other. A subsequent adjustment of a screening element 4 located on the grid 1 is therefore easily performed. Securing of the element 4 occurs when a securing pin 16 is inserted vertically to the plane of the screen through the bore 13 and the through-hole 12 from the top of the screening element 4.

A further embodiment of such a securing pin 16 is shown in exploded view in FIG. 11. A collar 19 is provided at the lower end of the neck 17, below which the end of the pin 16 has a bevel 20. The function of such a securing pin 16 can be seen in FIG. 12. The securing pin 16 is inserted by hand with neck 17 first passing through the through-holes 12 of adjacent screening elements 4. The collar 19 on the neck 17 must be forced through the smaller diameter of the through-hole 12. Since the tube sections 10, like the screening element 4, consist of synthetic resilient material, the walls of the through-holes 12 can accordingly expand. The synthetic resilient material of the securing pin 16 can also expand. The axial height of the collar 19 on the securing pin 16 is so selected that when the head 18 reaches the shoulder 14 between the through-hole 12 and the bore 13, the collar 19 is in a plane with the edge of the hole 3 in the support-bars 2. This results in the tube sections 10 being spread immediately below the holes 3 in the support-bars 2, so that a radially deformed expansion 31 of the tube sections 10, greater than the diameter of the hole 3 can occur. The screening elements 4 with the inserted securing pins 16 are secured to the support-bars 2 by means of the expanded members 31.

FIG. 13 shows another embodiment of the securing pin 16. A ring recess 25 is cut into the head 18 of the securing pin 16, which almost reaches to the base of the head 18. The diameter of the ring recess 25 is about the same as the diameter of the neck 17 of the securing pin 16. Thus the head 18 is divided into a core which represents a continuation of the neck 17, and an outer shell which is joined to the inner core of the head 18 by a thin bridge 26 at the base of the ring recess 25. If pressure is exerted on the top of securing pin 16, to the core when the pin is in position then the core shears at the bridge 26 and is driven together with the neck 17 down, out of the combined tube sections 10. With this embodiment, the collar 19 on the neck 17 of the securing pin 16 need not be forced again through the entire hole 12 of the semicircular tube sections 10.

A further embodiment of the securing pin 16 is shown in FIG. 16. This securing pin 16 has the same function as the securing pin described in connection with FIG. 3. The securing pin here has only a single groove 33 at about the middle of the head 18 for levering the securing pin 16 out of the screen deck.

Figure 9:
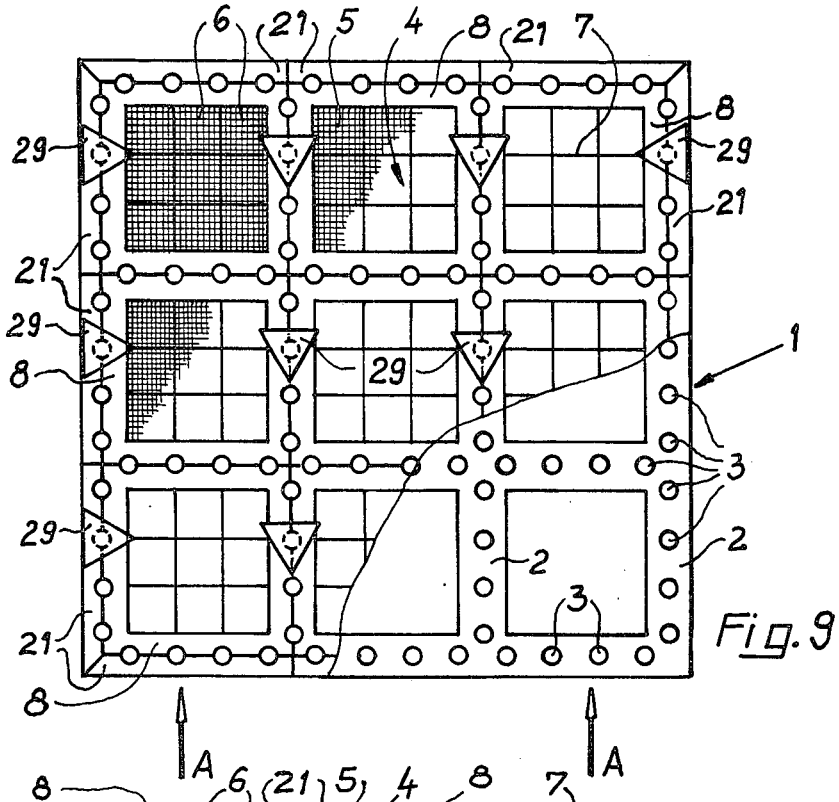
FIG. 9 : a plan view of a further screening according to the invention with fitted sieve elements.
Figure 14:
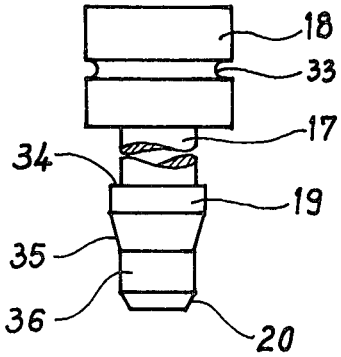
Figure 14:
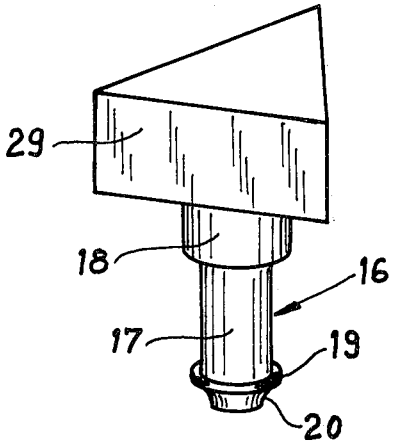

FIG. 14 shows a securing pin 16, with a head 18 on which there is provided a guide means 29. When the securing pin 16 is in position, the guide means 29 contacts on the top surface of the screening element 4 as is shown in FIG. 9. Instead of the illustrated prismatic embodiment, the guide means 29 can take the form of a hemisphere. Another embodiment of the securing pin is shown in FIG. 15. Here, the neck 17 of the securing pin 16 takes the form of a spreader into which a spreading member is driven from above. In the embodiment illustrated in FIG. 15, this member is a spreader screw 27 which is screwed into a conical bore 28 after insertion of the securing pin 16. The spreader screw 27 has a cylindrical core, which acts to widen the neck 17 of the elastic securing pin 16. The tube sections 10 are radially widened below the support-bars 2, which secures the screening elements 4 to the grid 1. To remove the screening element 4, the spreader screw 27 need only be screwed out of the neck 17 of the securing pin 16. In order that the head of the spreader screw 27 does not project above the upper surface of the sieve element 4, the head 18 of the securing pin 16, over which the head of the spreader screw 27 projects, is sunk in the bore 13. The top of the bore 13 is sealed by means of a cap 32 which is suitably made of the same material as the screening element 4. The cap 32 is positioned with its top in a plane including the upper surface of the screening element 4.

In principle, all the described embodiments of the securing pins 16 can be used in connection both with tube sections 10 situated on the corners and also with the described semicircular tube sections 10 on the sides.

Because the screening elements 4 only cover horizontally as far as the middle of the support-bars 2, frame strips 21 are provided for the outer support-bars 2 of the grid 1, such as is shown in FIG. 17. Such frame strips 21 can also be used to cover spaces which might occur between the whole screen deck and the side walls of the screening box. For this purpose, the frame strips 21 are made correspondingly wider. Like the screening elements 4, the frame strips 21 also have on the inner edge at the corners thereof or along the entire inner edge, tube sections 10 which combine in the previously described manner with the corresponding tube sections 10 of the adjacent screening elements 4. Securing the outer screening elements 4 together with the frame strips 21 is achieved by securing pins in the same manner as the adjacent screening elements are secured to the inner support-bars 2.

Figure 10:
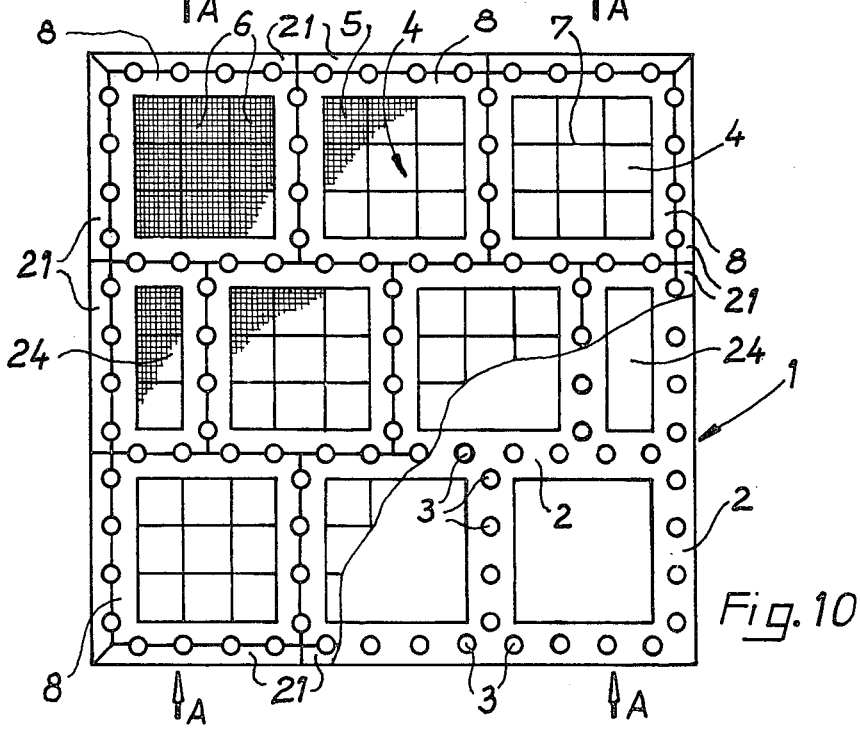
FIG. 10 : a plan view of another screening deck according to the invention with fitted screening elements.

Depending on the construction of the grid 1, the screening elements 4 can be arranged in a line in the direction of travel of the substance being screened, as indicated by the arrow "A" in the FIGS. 9 and 10. With screening elements 4 of square or rectangular form, such as are generally preferred, dead zones along the frames 8 in the direction of travel occur, on which the substance to be screened moves without touching an active screen zone 6. To overcome this disadvantge, the previously described guide member 29 or ribs 41 in connection with FIG. 8 or 14 are provided on the securing pins 16. Unlike known guide means or ribs which are secured to the screening elements and which combine along the frame sides of the elements, the guide member 29 and ribs 41 according to the invention have the advantage that when they are worn they are easy to replace together with the securing pins 16. In the case of the known guide means and ribs which are secured to the sieve elements, the entire screening element must be replaced when the guide means or ribs are worn.

As FIG. 9 shows, the securing pins 16 with the guide member 29 are so inserted in the semicircular tube sections 10 that a point of the guide member 29 is directed against the direction A of the screened substance. Only the guide member 29 at the edges of the screen deck are set with a sloping surface meeting and deflecting the material towards the centre of the screening deck.

The guide member 29 on top of the securing pins 16 in the illustrated embodiments is triangular. Fundamentally, the guide means 29 can be of any desired shape provided that it ensures that the substance being screened is directed onto the active screening zones 6. There is a possibility that when a one-sided load is applied by the substance being screened to the triangular embodiment of the guide means 29, rotation of the guide 29 and thus of the preferably integrally formed securing pin 16 may occur. Such rotation of the securing pins 16 can be avoided by giving the guide member 29 a suitable shape. Such a shape can be round, cylindrical, or as previously mentioned, it is also possible to give the guide member 29 a hemispherical form.

FIG. 10 shows an arrangement of the screening elements 4 in which there is no necessity for such guide member 29. In the direction of travel "A", the screening elements 4 are not arranged in line, one behind the other, but instead transverse rows of screening elements 4 are alternately offset. In order to close the spaces which occur at the ends of the offset rows of sieve elements 4 by square or rectangular base form of the grid 1, filler elements 24 are provided, which are either wider or narrower than the screening elements 4. In a preferred embodiment, the filler elements 24 are half as wide as the screening elements 4. If an even number of tube sections 10 are provided on the side walls 9 of the screening elements 4, the short side walls of the filler elements 24 can be given half the number of tube sections 10. With a suitably corresponding arrangement of the support-bars 2 in the grid 1, the screening elements 4 set in a rectangular or quadrangular base shape overlap each other transversely in the direction of travel by a half.

I claim:

1. A screening assembly for separating ore-like materials according to size, and comprising:

a polygonally shaped grid including a plurality of spaced supporting bars, each supporting bar including at least one aperture extending therethrough;

at least one replaceable screening element positioned within a gap formed by said spaced supporting bars;

hollow tubular protrusion means attached to said screening element and extending through said aperture;

said protrusion means having an external diameter less than the internal diameter of the surrounding aperture wall; and separate securing means extending through said protrusion means for wedging said protrusion means into releasable contact with said aperture wall, to provide a continuous screening surface covering said grid member;

said securing means having an end surface extending substantially within the plane of a top surface of said screening element when said securing means is completely inserted into said protrusion means.

2. An apparatus according to claim 1, wherein said plurality of supporting bars intersect one another, with a plurality of separate apertures extending through said supporting bars at said intersections.

3. An apparatus according to claim 2, wherein each of said supporting bars further includes a plurality of additional spaced apertures extending therethrough.

4. An apparatus according to claim 1, wherein said plurality of supporting bars extend in parallel directions, a plurality of separate apertures extending through each of said supporting bars.

5. An apparatus according to claim 1, wherein said screening assembly includes a plurality of replaceable screening elements.

6. An apparatus according to claim 5, wherein each screening element comprises:

a frame portion surrounding a plurality of spaced screening zones, with each screening zone including a plurality of openings extending therethrough and functioning to separate said ore-like material by size, and a plurality of interconnecting stays supporting said screening zones and attached to said frame portion.

7. An apparatus according to claim 6, wherein said screening zones and said frame portion are constructed of different materials, with said frame portion further including a plurality of reinforcement strips extending longitudinally therethrough.

8. An apparatus according to claim 5, wherein a plurality of protrusion means are integrally formed with each of said replaceable screening elements.

9. An apparatus according to claim 8, wherein each of said protrusion means comprises a longitudinally extending deformable member which is formed with cylindrically shaped inner and outer wall surfaces, and further includes a chamfered end portion.

10. An apparatus according to claim 9, wherein a plurality of protrusion means are attached to adjacent screening elements and extend through a single aperture forming a deformable hollow tubular conduit.

11. An apparatus according to claim 10, wherein said securing means extends through said hollow tubular conduit wedging a portion of said conduit against said aperture wall.

12. An apparatus according to claim 9, wherein each of said screening elements includes, a first curved surface portion corresponding in shape to said inner surface of said protrusion means and extending from said protrusion means across a portion of a longitudinally extending edge surface of said screening element, a second curved surface portion of greater cross-sectional diameter than said first surface, and extending from said first surface portion across the remaining portion of said longitudinally extending edge surface, and a third surface extending into said edge surface of said screening element and joining said first and second surfaces.

13. An apparatus according to claim 12, wherein said first, second and third curved surfaces formed on adjacent screening elements abut one another to form said hollow tubular passageway extending completely through said screening elements.

14. An apparatus according to claim 12, wherein said second surface portion extends a greater distance across said longitudinally extending edge surface than said first surface portion.

15. An apparatus according to claim 14, wherein a protrusion means attached to a first screening element is extendable through a second surface portion formed on a second screening element and into abutment with a third surface formed on said second screening element, whereby said first screening element is stacked on said second screening element.

16. An apparatus according to claim 8, wherein a plurality of securing means are formed in the shape of cylindrical pin members and extend through each of said plurality of protrusion means, with each of said pins being connected to a guide rib and said guide rib being positioned to abut a surface of said screening elements when said pin members are properly positioned.

17. An apparatus according to claim 5, wherein said screening elements are formed of various sizes and are positioned within said grid with supporting bars extending therebetween.

18. An apparatus according to claim 1, wherein said securing means comprises:

a generally cylindrically shaped pin member formed of resilient material;

said pin including a tapered end portion for easy insertion through said protrusion means;

said pin further including a longitudinally extending surface portion of increased diameter which functions to wedge said protrusion means against said aperture wall;

and said pin also including at least one groove extending about said cylindrically shaped surface which functions to receive a tool to remove said pin from said protrusion means.

19. An apparatus according to claim 18, wherein a polygonally shaped guide member is attached to said end surface of said pin for channelling said ore-like material across said screening elements.

20. An apparatus according to claim 18, wherein said securing means comprises a hollow, tubularly shaped pin, which is recessed with said screening element, and a separate cylindrically rod positioned within said hollow pin, forcing said hollow pin to expand said protrusion means against said aperture wall.

21. An apparatus according to claim 20, wherein said securing means further includes a cap member positioned adjacent said pin and rod and having an end surface mounted flush with said screening element to provide a seal preventing leakage through said aperture.

22. An apparatus according to claim 1, wherein a frame member surrounds said grid and includes a plurality of recessed portions aligned with recessed portions formed on an outer longitudinally extending edge surface of said grid.

23. An apparatus according to claim 1, wherein said securing means comprises a generally cylindrically shaped pin member including an enlarged head portion connected to said generally cylindrically shaped pin member by a frangible cylindrically extending neck, wherein said neck ruptures when excessive pressure is applied to said head portion of said pin allowing said pin to pass completely through said aperture in said supporting bar.

* * * * *